United States Patent [19]

Cheng

[11] 4,254,577

[45] Mar. 10, 1981

[54] MODEL VEHICLE

[76] Inventor: Richard C. M. Cheng, Suite 1604, Austin Center, Austin Ave., Kowloon, Hong Kong

[21] Appl. No.: 874,388

[22] Filed: Feb. 2, 1978

[51] Int. Cl.[3] ..... A63H 17/36; A63F 9/14; F16D 13/04; F16D 41/04

[52] U.S. Cl. ..... 46/258; 273/86 B; 74/812; 74/126; 192/46; 192/48.92; 46/262

[58] Field of Search ..... 46/257–262; 273/86 B; 192/46, 48.92, 45.1, 45.2; 74/812, 126

[56] References Cited

U.S. PATENT DOCUMENTS

| | | | |
|---|---|---|---|
| 215,762 | 5/1879 | McMasters | 192/46 |
| 716,041 | 12/1902 | Houghtaling | 192/46 |
| 2,172,416 | 9/1939 | Swenson | 46/213 |
| 3,453,970 | 7/1969 | Hansen | 273/86 B |
| 3,601,400 | 8/1971 | Boles | 46/253 |
| 3,813,812 | 6/1974 | Barlow et al. | 46/259 |
| 3,837,286 | 9/1974 | Brand et al. | 46/259 |
| 3,909,276 | 9/1975 | Wolf | 46/253 |
| 4,055,021 | 10/1977 | Okamoto | 46/251 |
| 4,156,987 | 6/1979 | Lahr | 46/259 |

FOREIGN PATENT DOCUMENTS

| | | | |
|---|---|---|---|
| 2809250 | 9/1978 | Fed. Rep. of Germany | 46/257 |

*Primary Examiner*—F. Barry Shay
*Assistant Examiner*—Michael J. Foycik, Jr.
*Attorney, Agent, or Firm*—Robert K. Youtie

[57] ABSTRACT

A model vehicle of the steerable road racing type for confined movement along a trough type roadway or track of plural land width including a dirigible wheeled chassis carrying a drive motor, a clutch mechanism operative to drive the wheeled running gear continuously in forward direction upon actuation of the motor in opposite directions, and an operating mechanism steering the running gear in opposite directions responsive to the motor running in opposite directions for controlling vehicle movement between lanes and along a selected trough side wall.

7 Claims, 6 Drawing Figures

MODEL VEHICLE

BACKGROUND OF THE INVENTION

In the field of model racing vehicles, such as road racing cars, there have been proposed means for steering the vehicles to change lanes and pass one another, all under remote control of an operator. However, such lane changing model vehicles have not been entirely satisfactory, involving complex steering and driving mechanisms readily subject to damage and malfunction, including the need for shiftable components of substantial mass, complex cam surfaces and followers, unrealistic operation by single wheel drive, and other difficulties.

Examples of the above mentioned prior art are found in the below listed U.S. patents:

| | | |
|---|---|---|
| 3,731,428 | 3,717,952 | 3,239,963 |
| 3,742,875 | 3,878,521 | 3,447,257 |
| 3,748,780 | 3,482,352 | 3,772,824 |
| 3,765,693 | 3,600,851 | 3,797,404 |
| 3,799,544 | 3,780,470 | 3,837,286 |
| 3,827,693 | 3,961,441 | 3,813,812 |
| 3,774,340 | 2,993,299 | |

SUMMARY OF THE INVENTION

Accordingly, it is an important object of the present invention to provide a model vehicle construction which overcomes the above-mentioned difficulties, is extremely simple in structure for economy in manufacture and reliability in operation, being selectively remotely operable to shift from one lane to another within a trough type roadway for movement along a selected one of the roadway side walls or confining barriers.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENT

Figure 1:
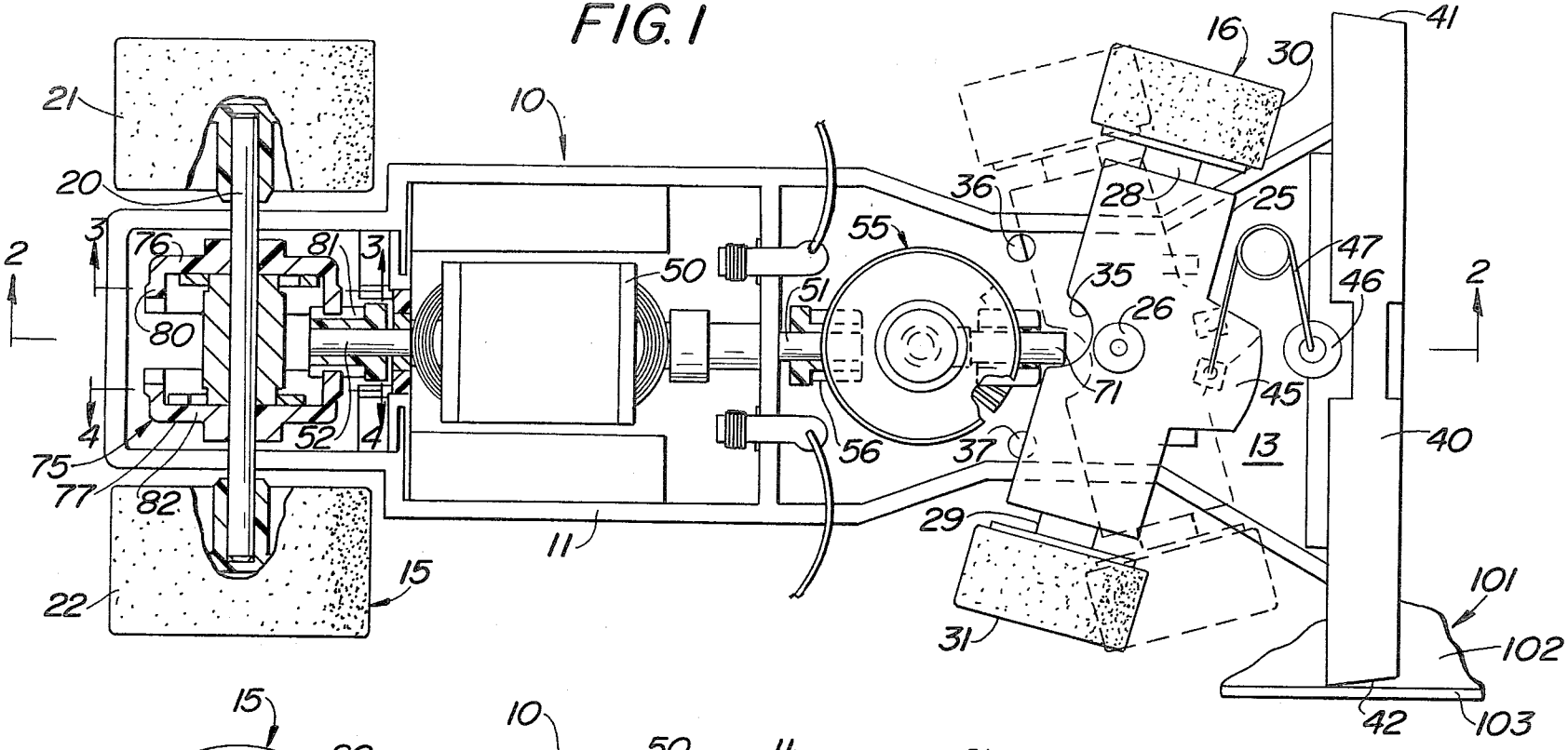
FIG. 1 is a top plan view showing a model vehicle constructed in accordance with the teachings of the present invention, partly broken away to illustrate internal construction, and illustrating its operational relationship with a trough-type roadway or track.
Figure 2:
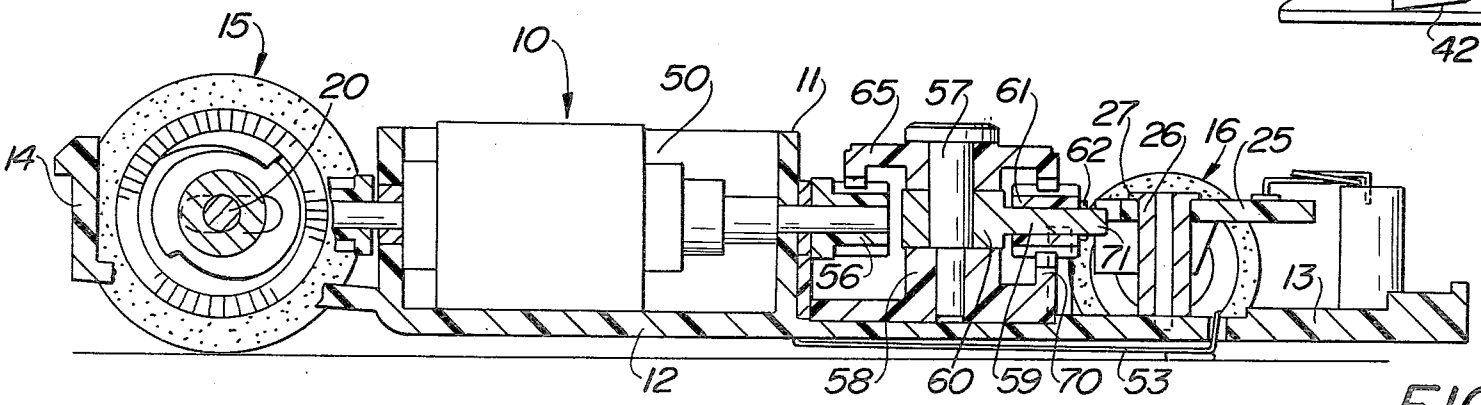
FIG. 2 is a longitudinal sectional view taken generally along the line 2—2 of FIG. 1.

Referring now more particularly to the drawings, and specifically to FIGS. 1 and 2 thereof, a model vehicle is shown therein and generally designated 10, including an elongate, generally horizontally disposed frame or chassis 11 having a bottom wall 12 extending forwardly to a forward region 13, and rearwardly to an open rearward region 14.

Rear wheeled running gear, generally designated 15, are mounted by the rear chassis portion 14, and forward wheeled running gear, generally designated 16, are mounted by the forward chassis region 13.

The rear wheeled running gear 15 may include a generally horizontally disposed, laterally extending axle or shaft 20 axially rotatably supported by and extending laterally through and beyond opposite sides of the rear chassis region 14. Carried by opposite, outboard ends of rear axle 20 are respective left and right rear wheels 21 and 22, being keyed or otherwise rotatable with the axle.

The forward or front running gear 16 may include a laterally extending, generally horzontal wheel carrier or axle means 25 extending laterally across the forward chassis region and mounted thereon for swinging movement about an upstanding pivot or pin 26. As best seen in FIG. 2, the swingable member or axle means 25 is spaced over the forward chassis region 13, and the pivot or pin 26 upstands from the forward chassis region through a medial location of the member 25 to mount the latter for pivotal movement about the vertical, laterally medial axis of pivot 26. An end enlargement or head 27 may be provided on the upper end of pivot 26 to retain the axle means 25 on the pivot.

Extending from opposite ends of the member 25 may be suitable wheel bearing means or journals 28 and 29 respectively rotatably carrying left and right front wheels 30 and 31.

The cross axle member 25 is provided on its rearward side with a rearwardly facing cutout or notch 35, proximate to and just rearward of the pivot 26, for a purpose appearing presently.

Upstanding from the forward chassis region 13, adjacent to opposite sides thereof and rearward of the transverse member or beam 25, are a pair of abutments or stop members 36 and 37. The stop member 37 is located to limit pivotal or swinging movement of the axle beam 25 in the rightward direction, by abutting engagement therewith, while the abutment or stop member 36 is located to limit axle beam swinging movement to steer in the leftward direction, as in the phantom position of the forward steerable running gear 16.

Extending laterally across the forward end of chassis 11 is a bumper, runner or guide member 40 which terminates at its opposite ends 41 and 42 laterally outwardly beyond the forward wheeled running gear 16. Thus, upon steering movement of the vehicle 10 toward a track side wall the front bumper 40 runs along the side wall for limiting engagement therewith.

The pivotable axle member or beam 25 is also provided laterally medially thereof with a forward projection or arm 45 forward of the pivot 26 and swingable with the beam rightward and leftward of the pivot. Just forward of the axle beams 25, laterally medially of the forward chassis region 13, and just rearward of the forward member or bumper 40, there may be provided an upstanding lug or boss 46. A torsion spring on other suitable resiliently expansile member 47 may have its opposite ends respectively extending into the axle beam extension 45 and lug 46, so as to resiliently, yieldably urge the same apart from each other. Thus, the resilient means or spring 47 will serve to snap the wheeled front running gear 16 toward their adjacent limiting position of steering movement. Hence, upon movement of the axle beam 25 to a position slightly beyond dead center, the resilient means or spring 47 will serve to continue pivotal movement of the axle beam toward its adjacent limiting position of steering movement, as shown in solid and phantom positions in FIG. 1.

A rotary motive means or electric motor 50 is mounted in the midregion of the chassis 11, extending longitudinally of the chassis and having forwardly and rearwardly extending stub shafts 51 and 52, respectively. The motor 50 is provided with electrical connections to current collectors, as at 53 in FIG. 2, beneath the chassis 11 for wiping engagement with track conductors in the conventional manner.

The axle member or beam 25 on its vertical pivot 26 and carrying wheels 30 and 31 may be considered as constituting the front wheeled running gear or steering means 16. Interposed between the dirigible front wheeled running gear or steering means 16 and the motive means or motor 50 is a steering gear operating means generally designated 55. Specifically, the steering gear operating means may include a pinion or gear 56 carried by the forward end shaft 51 of motor 50 for rotation therewith generally about the longitudinaly center line of the chassis. Just forward of the gear or pinion 56, and in alignment therewith longitudinally of the chassis, is provided an upstanding pin or shaft 57, say upstanding from a boss 58 on the chassis 11. An arm 59 extends generally radially from the pin 57, having at one end an eye 60 rotatably circumposed about the pin. The arm is provided with a rotary pinion or gear 61 rotatable about the arm 59 and swingable or rotatable with the arm about the pin 57. Suitable retaining means 62 may be provided on the arm 59 for rotatably retaining the pinion 61 on the arm.

Circumposed about the pin 57, rotatably thereon, and superposed over the eye 60 and pinions 56 and 61 is a generally circular crown or ring gear 65 having its teeth in meshing engagement with the teeth of both pinions 56 and 61. Thus, rotation of pinion 56 will effect rotation of gear 65 to drive pinion 61. As there is an additional gear 70 below and with its teeth extending upwardly toward the teeth of gear 65, forward of pin 57, which also meshes with pinion 61, the arm 59 is caused to swing about pin 57 upon rotation of pinion 56. However, the lower or upwardly facing gear 70 is of limited extent, being an arcuate segment only, or may be considered as an upwardly facing ring or crown gear having tooth interruption throughout a major portion of its extent. The interrupted lower crown gear or segment 70 is of such a length as to cause the arm 59 to swing about pin 57 a predetermined angle from the longitudinal center line illustrated in FIGS. 1 and 2, after which the pinion 61 rides off of or beyond the gear 70. The free outer end 71 of arm 59 extends into the rearwardly facing cutout or notch 35, and engages therein to swing the steering gear 16 beyond dead center, whereupon resilient means 47 continues movement of the steering gear to its other limiting position. In this manner, rotation of the motor 50, and its forward stub shaft 51 in opposite directions, effects movement of the steering gear 16 in opposite steering directions. As the pinion 61 rides beyond the gear segment 70 to prevent jamming of the steering gear operating means upon continued rotation of pinion 56 and crown gear 65, opposite directional rotation of the pinion 56 and steering gear 65 causes the pinion 61, by pivotal friction thereof, to rotate arm 59 toward and effect meshing engagement of pinion 61 with segment gear 70 to effect opposite directional steering movement in the same manner described hereinbefore.

Interposed in driving relation between the reversible direction motor 50, its rear stub shaft 52 and the rear wheeled running gear 15 are clutch means generally designated 75. In particular, the clutch means 75 includes a pair of clutches 76 and 77, which are essentially identical but oppositely arranged to effect forward driving rotation of the wheeled running gear 15 upon rotation of motor 50 in opposite directions.

The clutch 76 may include a crown or ring gear 80 rotatably circumposed about shaft or axle 20 on one side of the longitudinal center line of chassis 11 and in meshing engagement with a gear or pinion 81 keyed to the rear motor shaft 52, for rotation of the gear 80 by the motor. The other clutch 77 similarly includes a crown or ring gear 82 rotatably circumposed about the axle 20 on the opposite side of the chassis center line as gear 80, and in meshing engagement with the pinion 81 on the opposite side of the latter as gear 80. Thus, the crown gears 80 and 82 are rotated in opposite directions by the motor 50. The interior of crown gear 80 is provided with a tooth 83 of generally ratchet-like formation, including an abutment face or surface 84 generally radially of the gear 80, and a cam face or side 85, generally arcuate about the center of gear 80. The ring gear or crown gear 82 is similar to the ring gear 80, including an internal ratchet-like tooth 86 having an abutment surface or side 87 extending generally radially of the gear, and a relatively inclined cam side or surface 88 generally tangential to the gear.

A hub 90 is keyed or otherwise fixed to the axle 20 intermediate the crown gears 80 and 82, and is provided at opposite ends with radially elongate formations or bosses 91 and 92 located interiorly of respective gears 80 and 82. A disc-like engaging member 93 is disposed within ring gear 80, circumposed about axle 20 and provided with a generally central elongate slot 94 slidably receiving the boss 91. Thus, the engaging member or disc 93 is constrained to rotation with the axle 20 and hub 90, while being shiftable radially thereof within the limits of slot 94, the latter being of greater radial extent than the received boss 91. On its circumference, the engaging member or disc 93 is provided with one or more ratchet-like teeth 95 arranged for abutting engagement with the adjacent ratchet tooth 83 of ring gear 80 upon rotation in one relative direction, and adapted to cam past or ride over the tooth 83 upon relative rotation in the other direction.

Similarly, a disc-like engaging member 96 is circumposed about the shaft 20 and boss 92 within the ring gear 82, being provided centrally with a slot 97 slidably receiving and of greater radially extent than the boss 92 for radial shifting relative to the latter. The engaging member or disc 96 is provided on its peripheral edge with one or more ratchet-like teeth 98 configured for abutting driving engagement with the adjacent tooth 86 of ring gear 82 in one direction of relative movement between the disc and ring gear, and configured to cam past or ride over the ring gear tooth in the other direction of relative rotation.

Figure 5:
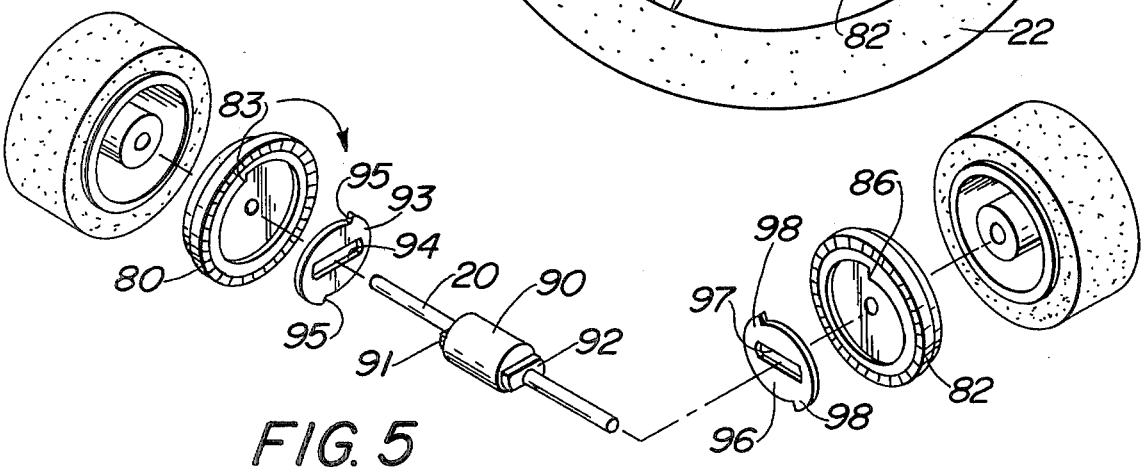
FIG. 5 is an exploded perspective view illustrating the rear wheel drive clutch mechanism of the present invention.

Thus, upon ring gear rotation in the direction of solid line arrow in FIG. 5, the ring gear 80 defines an annular drive member with its tooth 83 in driving engagement with a tooth 95 of the plate-like disc or engaging member 93. As the engaging plate 93 is, by its slot 94 nonrotatably receiving boss 91, rotatable with the axle 20, the latter is driven to rotate wheels 21 and 22 to drive the chassis forwardly.

Upon rotation of ring gear or drive member 80 in the direction of arrow 100, the tooth 83 rides over the teeth 95 so that the gear rotates relative to the engaging member 93 and axle 20.

Figure 3:
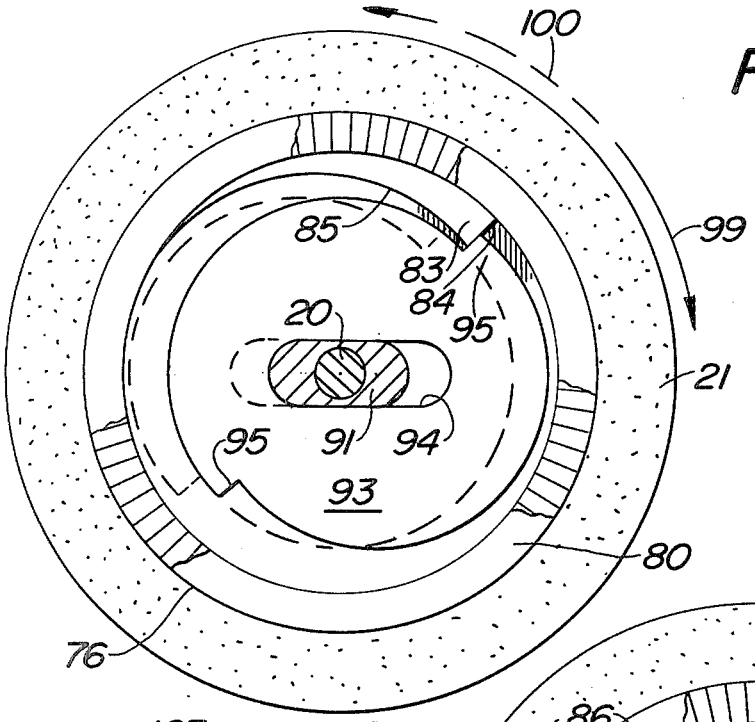
FIGS. 3 and 4 are partial sectional elevational views taken generally along the lines 3—3 and 4—4 of FIG. 1.
Figure 4:
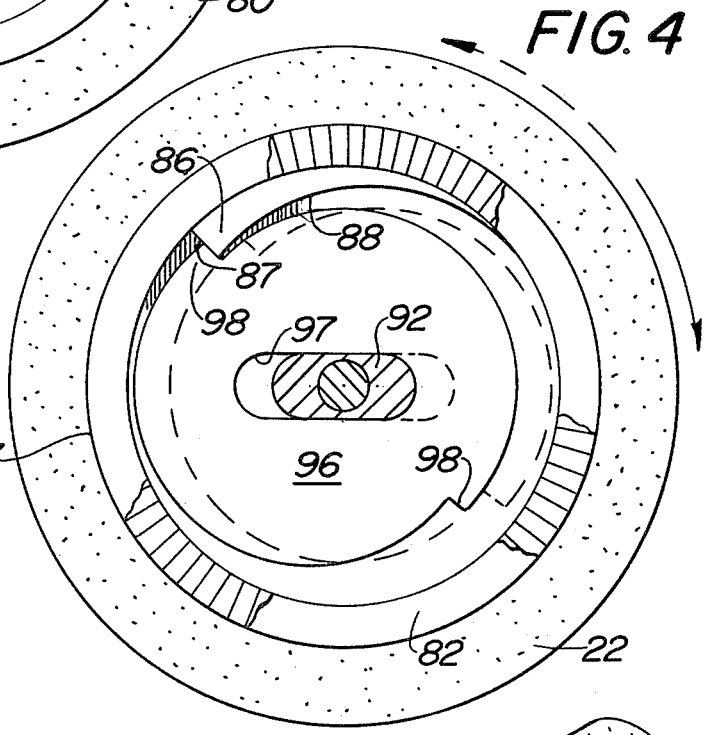

Operation of the clutch 77 of FIG. 4 is identical to that described in connection with the clutch means 76 in FIG. 3, however, by the opposite orientation of the clutch means 77 its associated wheel 22 is driven in the forward direction by the clutch means when the motor 50 drives the gear 80 in the direction of arrow 100. It will therefore be seen that the motor 50 serves to drive through the clutch means 76 and 77, the rear drive wheels 21 and 22 in the forward driving direction when the motor is driven in either of its rotative directions.

As noted hereinbefore, the motor 50 serves to steer the steering gear 16 in opposite directions corresponding to opposite directions of motor rotation.

Figure 6:
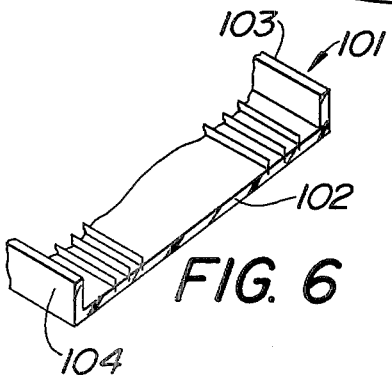
FIG. 6 is a partial perspective view illustrating a trough-type track construction for use with the instant model vehicle.

In operation of a model vehicle 10 within a trough-like track 101, as shown in FIG. 6, it will presently be apparent that the vehicle is capable of movement along either track lane, as selected, and to change lanes, as desired. The track 101 for use with the instant model vehicle is of a trough-type kind, including a bottom wall 102 of plural lanes, being two lanes in the illustrated embodiment. Upstanding from opposite side edges of the track bottom wall 102 are a pair of upstanding side walls or confining barriers or rails 103 and 104. In the solid line position of FIG. 1, it will be seen that the model vehicle 10 is moving rightward along track 101, the steering gear 16 being directed rightward with the bumper or guide member 40 riding along the rightward side wall or rail 103 of the track. Obviously, the side wall or rail 103 is essential to retain the vehicle 10 on the track bottom wall 102, as the front wheeled steering gear 16 is directed rightward against the side wall 103. When it is desired to changes lanes on the track 101, it is only necessary to reverse the direction of rotation of motor 50. This will not reverse the direction of rotation of the driving rear wheels 21 and 22, as discussed hereinbefore. However, it will swing operating arm 71 clockwise, as seen in FIG. 1, to rotate the steering gear 16 counterclockwise to its phantom line position. This will, of course, cause the vehicle to move leftward into the opposite lane of track 101 and ride against the other barrier side wall or rail 104 with its guide member or bumper 40. Reversal of the above described procedure may be achieved by mere reversal of the direction of motor 50, so as to complete a "road passing" operation.

From the foregoing, it is seen that the present invention provides a model vehicle for movement along a trough-type track which is remotely actuable to effect lane changing and passing, being extremely simple in construction for realistic and reliable operation throughout a long useful life, and which otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A model vehicle for movement along a trough having a bottom wall of plural lane width and spaced side walls on opposite sides of said bottom wall, said vehicle comprising a chassis, wheeled running gear on said chassis for rolling engagement with the trough bottom wall, rotary motive means carried by and having a housing fixed relative to said chassis for remote actuation in opposite angular directions, clutch means in driving relation between said motive means and running gear, said clutch means being operative to drive said running gear in forward direction upon actuation of said motive means in both of said opposite angular directions, steering gear associated with said running gear for steering the latter in opposite lateral directions toward respective trough side walls, and steering gear operating means interposed between said motive means and steering gear for operating the latter in opposite lateral directions upon motive means operation in opposite angular directions, said steering gear operating means comprising a pinion mounted for simultaneous axial rotation and back and forth movement to shift said steering gear, a rotary drive gear in meshing engagement with said pinion on one side, and a fixed gear in meshing engagement with said pinion on the other side for moving said pinion back and forth along said fixed gear upon rotation by said drive gear, said fixed gear being interrupted at opposite ends for back and forth pivotal movement beyond said fixed gear to overrun the latter without jamming, whereby said running gear operates in forward direction and is steered in opposite lateral directions by remote motive means actuation for desired vehicle lane change and movement along a selected trough side wall.

2. A model vehicle according to claim 1, said steering gear comprising a pivoted axle pivotable into opposite steering positions by said pinion, and overcenter resilient means urging said pivoted axle to its adjacent steering position.

3. A model vehicle according to claim 2, said pinion being movable back and forth sufficiently to shift said axle overcenter for urgence by said resilient means to the adjacent steering position.

4. A model vehicle for movement along a trough having a bottom wall of plural lane width and spaced side walls on opposite sides of said bottom wall, said vehicle comprising a chassis, wheeled running gear on said chassis for rolling engagement with the trough bottom wall, rotary motive means carried by said chassis for remote actuation in opposite angular directions, clutch means in driving relation between said motive means and running gear, said clutch means being operative to drive said running gear in forward direction upon actuation of said motive means in both of said opposite angular directions, steering gear associated with said running gear for steering the latter in opposite lateral directions toward respective trough side walls, and steering gear operating means interposed between said motive means and steering gear for operating the latter in opposite lateral directions upon motive means operation in opposite angular directions, whereby said running gear operates in forward direction and is steered in opposite lateral directions by remote motive means actuation for desired vehicle lane change and movement along a selected trough side wall, said steering gear comprising a pivoted axle pivotable into opposite steering positions, and overcenter resilient means urging said pivoted axle to its adjacent steering position, said steering gear operating means comprising an operating element movable back and forth sufficiently to shift said axle overcenter for urgence by said resilient means to the adjacent steering position, and toothed gears having tooth interruptions for overrunning in opposite directions without jamming upon axle shifting to opposite steering positions, said toothed gears comprising a pinion mounted for simultaneous axial rotation and back and forth movement to shift said pivoted axle, a rotary drive gear in meshing engagement with said pinion on one side, and a fixed gear in meshing engagement with said pinion on the other side for moving said pinion back and forth along said fixed gear upon rotation by said drive gear, said fixed gear being interrupted at opposite ends for back and forth pivotal movement beyond said fixed gear to overrun the latter without jamming.

5. A model vehicle for movement along a trough having a bottom wall of plural lane width and spaced side walls on opposite sides of said bottom wall, said vehicle comprising a chassis, wheeled running gear on said chassis for rolling engagement with the trough bottom wall, rotary motive means carried by and having a housing fixed relative to said chassis for remote actuation in opposite angular directions, clutch means in driving relation between said motive means and running gear, said clutch means being operative to drive said running gear in forward direction upon actuation of said motive means in both of said opposite angular directions, steering gear associated with said running gear for steering the latter in opposite lateral directions toward respective trough side walls, and steering gear operating means interposed between said motive means and steering gear for operating the latter in opposite lateral directions upon motive means operation in opposite angular directions, said steering gear operating means comprising an operating element pivoted to said chassis for swinging back and forth movement between extreme laterally opposite positions upon motive means motion in opposite angular directions and engageable with said steering gear to respectively shift the latter in opposite angular directions upon operating element movement through an intermediate angular displacement less than said swinging back and forth movement between said extreme positions, said operating element disengaging from said steering gear on operating element movement beyond said intermediate angular displacement toward said extreme positions.

6. A model vehicle according to claim 5, said steering gear operating means comprising positive motion transmitting means for transmitting motion to said operating element through said intermediate angular displacement, and frictional motion transmitting means for transmitting motion to said operating element beyond said intermediate angular displacement.

7. A model vehicle according to claim 6, in combination with yieldable retaining means yieldably retaining said steering gear in both of its opposite angular directions.

* * * * *